US008242970B2

(12) United States Patent
Fukui et al.

(10) Patent No.: US 8,242,970 B2
(45) Date of Patent: Aug. 14, 2012

(54) ANTENNA APPARATUS

(75) Inventors: Shinji Fukui, Okazaki (JP); Mitsuru Fujita, Toyohashi (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 416 days.

(21) Appl. No.: 12/462,415

(22) Filed: Aug. 4, 2009

(65) Prior Publication Data

US 2010/0045536 A1 Feb. 25, 2010

(30) Foreign Application Priority Data

Aug. 20, 2008 (JP) ..... 2008-211951

(51) Int. Cl.
*H01Q 15/02* (2006.01)
*H01Q 9/38* (2006.01)
*H01Q 1/38* (2006.01)

(52) U.S. Cl. ..... 343/909; 343/829; 343/700 MS

(58) Field of Classification Search ..... 343/700 MS, 343/702, 846, 909, 829
See application file for complete search history.

(56) References Cited

U.S. PATENT DOCUMENTS

| | | | | |
|---|---|---|---|---|
| 4,594,595 | A * | 6/1986 | Struckman | 343/770 |
| 7,145,518 | B2 * | 12/2006 | Tanaka et al. | 343/909 |
| 7,405,698 | B2 * | 7/2008 | de Rochemont | 343/700 MS |
| 7,423,608 | B2 * | 9/2008 | Dunn et al. | 343/909 |
| 7,902,585 | B2 * | 3/2011 | Larson et al. | 257/312 |
| 2003/0052834 | A1 | 3/2003 | Sievenpiper et al. | |
| 2005/0068233 | A1 | 3/2005 | Tanaka et al. | |
| 2007/0200788 | A1 | 8/2007 | Nakano et al. | |
| 2008/0272963 | A1 * | 11/2008 | Chang et al. | 343/700 MS |
| 2010/0066629 | A1 * | 3/2010 | Sievenpiper | 343/834 |

FOREIGN PATENT DOCUMENTS

| | | |
|---|---|---|
| JP | 2001-267834 | 9/2001 |
| JP | 2005-110273 | 4/2005 |
| JP | 2006-211327 | 8/2006 |
| JP | 2007-235460 | 9/2007 |

OTHER PUBLICATIONS

Office Action dated May 25, 2010 in Japanese Application No. 2008-211951 with English translation thereof.
Sievenpiper et al, "A Tunable Impedance Surface Performing as a Reconfigurable Beam Steering Reflector", IEEE Transactions on Antennas and Propagation, vol. 50, No. 3, Mar. 2002.
Sievenpiper et al, "Two-Dimensional Beam Steering Using an Electrically Tunable Impedance Surface", IEEE Transactions on Antennas and Propagation, vol. 51, No. 10, Oct. 2003.

* cited by examiner

*Primary Examiner* — Jacob Y Choi
*Assistant Examiner* — Hasan Islam
(74) *Attorney, Agent, or Firm* — Harness, Dickey & Pierce, PLC

(57) ABSTRACT

An antenna apparatus is disclosed. The antenna apparatus includes a board and a line antenna. The board includes: a base part having dielectric layers and a conductive layer disposed between the dielectric layers; multiple metal plates arranged on one surface of the base part while being spaced apart at even intervals so as to provide a band-gap surface; and a connection part via which the conductive layer is electrically connectable with the multiple metal plates. The line antenna is located on a band-gap surface side of the board, is arranged along the band gap surface, and is configured to receive and transmit the electromagnetic wave within an operating frequency band. The connection part includes a first adjustment circuit that is configured to individually adjust an impedance between the conductive layer and each of the plurality of metal plates.

8 Claims, 5 Drawing Sheets

ANTENNA APPARATUS

CROSS REFERENCE TO RELATED APPLICATION

The present application is based on Japanese Patent Applications No. 2008-211951 filed on Aug. 20, 2008, disclosure of which is incorporated herein by reference.

BACKGROUND OF THE INVENTION

1. Field of the Invention

The present invention relates to an antenna apparatus configured using a board.

2. Description of Related Art

A patch antenna is frequently used as an in-vehicle antenna for communicating with GPS (Global Positioning System), ETC (Electronic Toll Collection) system and the like, as is described in JP-2001-267834A for example.

Since the in-vehicle antenna is used in a noisy environment, antenna directivity is changed in accordance with an environmental change so that the in-vehicle antenna can perform communication in a noise reduced state. From a viewpoint of suppressing an increase in antenna apparatus size, it may be preferable that an orientation of an antenna apparatus be not changed by mechanical control but a characteristic of the antenna apparatus such as directivity, radiation pattern and the like be changed by electric control.

For a single antenna such as a patch antenna and the like, however, it has been difficult to largely change the directivity or the radiation pattern by electrical control only.

SUMMARY OF THE INVENTION

In view of the above and other difficulties, it is an objective of the present invention to provide an antenna apparatus that is capable of largely changing a characteristic of the antenna apparatus such as directivity, radiation pattern and the like by electrical control.

According to an aspect of the present invention, an antenna apparatus is provided. The antenna apparatus includes a board and a line antenna. The board includes a base part, multiple metal plates and a connection part. The base part has a pair of dielectric layers and a conductive layer disposed between the pair of dielectric layers. The multiple metal plates are the same in shape, and are two dimensionally arranged on one surface of the base part while being spaced apart at even intervals so that the one surface of the base part is configured to be a band-gap surface that blocks propagation of electromagnetic wave within a predetermined frequency band. The conductive layer is electrically connectable with the multiple metal plates via the connection part. The line antenna is located on a band-gap surface side of the board, is arranged along the band gap surface, and is configured to receive and transmit the electromagnetic wave within an operating frequency band. The operating frequency band is within the predetermined frequency band. The connection part includes a first adjustment circuit that is configured to individually adjust an impedance between the conductive layer and each of the multiple metal plates.

According to the above antenna apparatus, the above antenna apparatus can operate as a monopole antenna, an array antenna, or a patch antenna depending on the impedance between the conductive layer and each of the multiple metal plates, the impedance being adjusted by the first adjustment circuit. The antenna apparatus is therefore capable of largely changing a characteristic of thereof such as directivity, radiation pattern and the like by electrical control, without the use of mechanical control.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EXEMPLARY EMBODIMENTS

The exemplary embodiments are described below with reference to the accompanying drawings.

(Device Configuration)

Figure 1C:
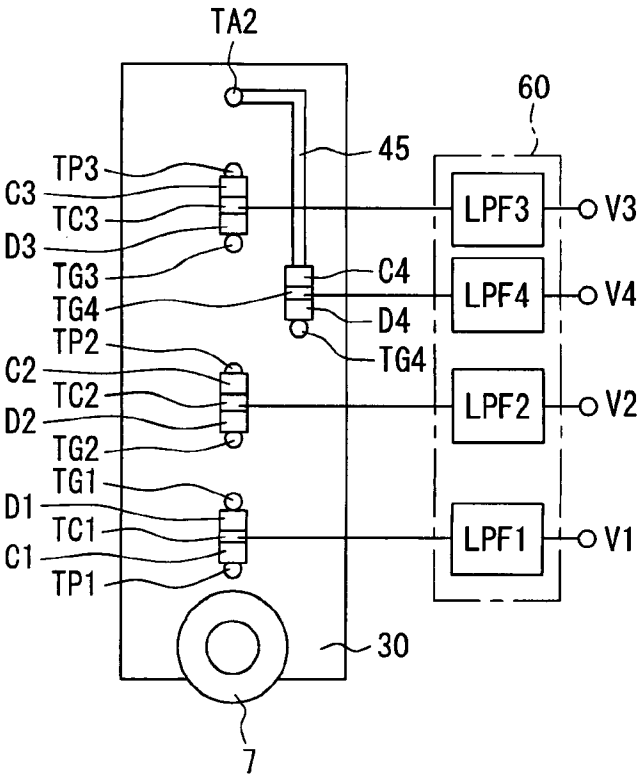
FIG. 1C is diagram illustrating a rear view of the antenna apparatus.
Figure 1B:
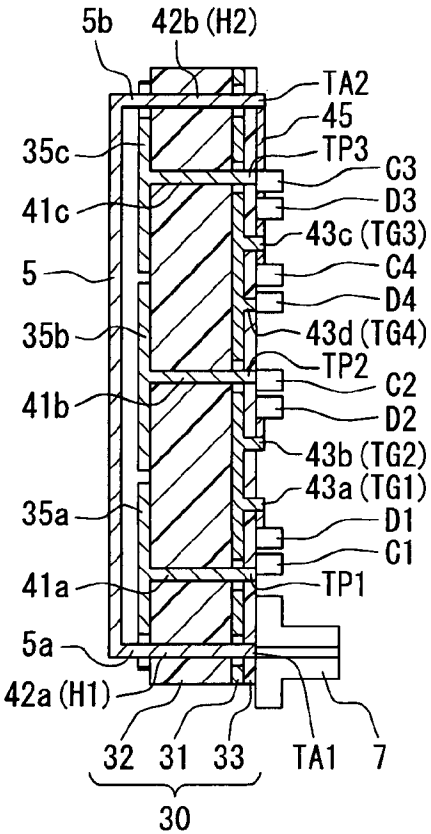
FIG. 1B is a diagram illustrating a sectional view of the antenna apparatus taken along line IB-IB in FIG. 1A.
Figure 1A:
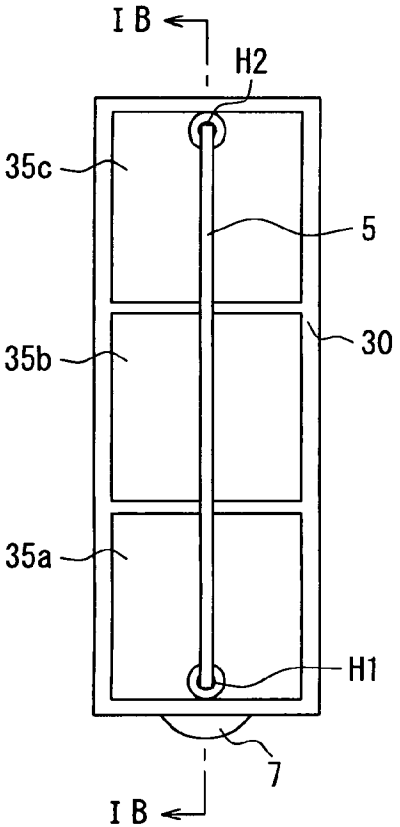
FIG. 1A is a diagram illustrating a plan view of an antenna apparatus.

FIGS. 1A to 1C are diagrams each illustrating a configuration of an in-vehicle antenna apparatus 1 according to one embodiment. FIG. 1A illustrates a front plan view, FIG. 1B a sectional view taken along line IB-IB in FIG. 1A, and FIG. 1C a rear plan view.

As shown in FIGS. 1A to 1C, the antenna apparatus 1 includes a board 3, a line antenna 5, and a connector 7. The board 3 includes a structure having a high-impedance at a predetermined specific frequency band. The line antenna 5 is located on one side of the board 3, and is about one-quarter wavelength long of electromagnetic wave having an operating frequency, which is within the specific frequency band. The connector 7 is located on an opposite side of the board 3 from the line antenna 5 and is used for power feeding to the line antenna 5. The side of the board on which the line antenna 5 is located is also referred to as an antenna arranged surface side.

In the followings, one end and the other end of the line antenna 5 are also refereed to as a feeding end 5*a* and a non-feeding end 5*b*, respectively. The line antenna 5 and the board 3 has therebetween a clearance, so that any parts of the line antenna 5 except the feeding end 5*a* and the non-feeding end 5*b* does not contact with the board 3.

(Board Configuration)

The board 3 includes a board base part 30 and multiple metal plates 35. The board base part 30 has a multilayer structure in which a conductive layer 31 made of metal is disposed between a first dielectric layer 32 and a second dielectric layer 33. Each of the first and second dielectric layers 32, 33 is made of a dielectric material and has a plate shape. The multiple metal plates 35 cover an outer surface of the board base part 30, the outer surface being a surface of the first dielectric layer 32. The multiple metal plates 35 are the same in shape, and are arranged in a line while being spaced apart at even intervals. In one embodiment, the multiple metal plates 35 are three metal plates 35*a* to 35*c* each having a square shape.

In the followings, a surface of the board 3 or the board base part 30 on which the metal plates 35 are located is also referred to as a band gap surface. Further, another surface of the board 3 or the board base part 30 opposite to the band gap surface is also refereed to as a circuit mounting surface.

The board 3 has a group of first via holes 41 (41*a* to 41*c*), a group of second via holes 42 (42*a*, 42*b*) and a group of third via holes 43 (43*a* to 43*d*). For example, each of the first via holes 41 may be a through-hole via, each of the second via holes 42 may be also a through-hole via, and each of the third via holes 43 may be a blind via. One end of each first via hole 41 is connected with a center of a corresponding one of the metal plates 35, and another end forms a terminal TP (TP1 to TP3) on the circuit mounting surface. One end of each second via hole 42 is located on the band gap surface and acts as an attachment opening H1, H2 for the feeding end 5*a* or the non-feeding end 5*b* of the line antenna 5. Another end of each second via hole 42 is located on the circuit mounting surface and forms a terminal TA (TA1, TA2). One end of each third via hole 43 is connected with the conductive layer 31 and another end forms a ground terminal TG (TG1 to TG 4) on the circuit mounting surface.

The metal plates 35*a* and 35*c*, which are located on the band gap surface where the attachment openings H1, H2 are formed, have cut parts. Through the cut parts, surface parts of the first dielectric layer 32 each surrounding the corresponding attachment opening H1, H2 are exposed, so that the metal plates 35 are prevented from contacting with the attachment openings H1, H2 and the line antenna 5 attached into the attachment openings H1, H2.

The conductive layer 31 also has cut parts so that the conductive layer 31 is prevented from contacting with the first and second via holes 41, 42, which penetrate the board base part 30.

A thickness and a material (which determines a dielectric constant) of each of the first and second dielectric layers 32, 33, the number and the size of the metal plates 35, the interval between the metal plates 35 are set so that the band gap surface has a high impedance at the specific frequency band. In other words, the board 3 has an EBG (Electromagnetic Band-Gap) structure.

A stub 45 and control terminals TC (TC1 to TC4) are located on the circuit mounting surface of the board 3. The stub 45 provides a terminating resistance to the line antenna 5. The control terminals TC1 to TC4 are used for applying control voltages V1 to V4, respectively.

The terminal TPi and the ground terminal TGi are located on opposite sides of the control terminal TCi, where i=1, 2, 3. One end of the stub 45 is connected with the antenna terminal TA2, and the other end is provided on an opposite side of the control terminal TC4 from the ground terminal TG4. The antenna terminal T1 is connected with the connector 7.

Capacitors C (C1 to C3) for preventing short circuit are provided between the terminals TP1 to TP3 and the control terminals TC1 to TC3. A capacitor C4 for preventing short circuit is provided between the stub 45 and the control terminal TC4. Variable capacitance diodes D1 to D4 are provided between the control terminals TC1 to TC4 and the ground terminals TG1 to TG4.

The control voltages V1 to V4 are respectively applied to the control terminals TC1 to TC4 via low pass filters 60 (LPF1 to LPF4). Each low pass filter 60 may have a known configuration including a coil and a capacitor.

Figure 2:
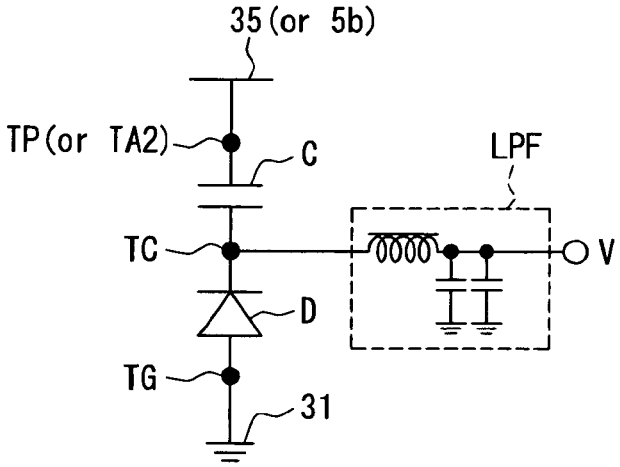
FIG. 2 is a diagram illustrating a circuit configuration of a connection part.

FIG. 2 is a circuit diagram illustrating connection among the following components: the metal plate 35 or the non-feeding end 5*b* of the line antenna 5; the conductive layer 31; the terminal TP (TP1 to TP3) or the terminal TA2, the terminal TC (TC1 to TC4); the ground terminal TG (TG1 to TG4); the capacitor C (C1 to C4); the variable capacitance diode D (D1 to D4); and the low pass filter LPF (LPF1 to LPF4).

The metal plate 35 is connected with the conductive layer 31 via the terminal TP, the capacitor C and the variable capacitance diode D. Similarly, the non-feeding end 5*b* of the line antenna 5 is connected with the conductive layer 31 via the terminal TA2, the capacitor C and the variable capacitance diode D. Via the low pass filter LPF, the control voltage V can be applied to the control terminal TC, which is provided between the capacitor C and the variable capacitance diode D. By applying the control voltage V, it is possible change a capacitance of the variable capacitance diode D. In the present embodiment, a connection part of the board 3 includes: the ground terminal TG; the group of first via holes 41; the via hole 42*b*; and a circuit configuration between the terminal TP or TA2.

Figure 3:
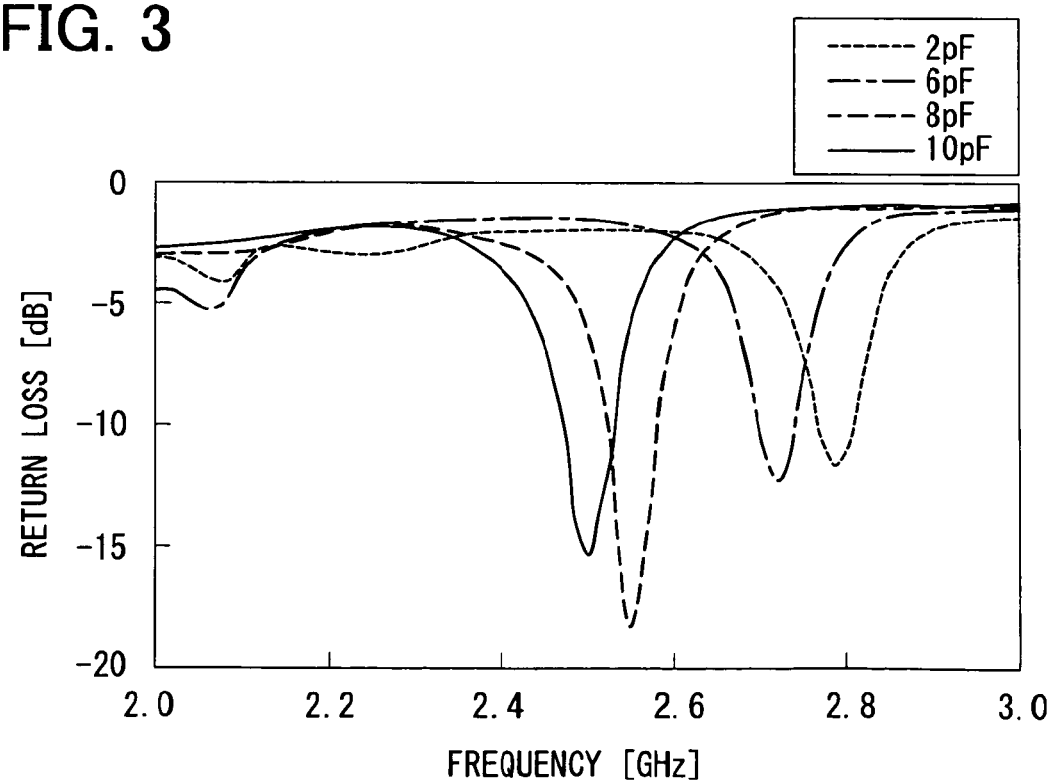
FIG. 3 is a graph illustrating a relationship between return losses and frequencies.

FIG. 3 is a graph illustrating relationships between return losses at the feeding end 5*a* of the line antenna 5 and input signal frequencies while the capacitance of the variable capacitance diodes D1 to D3 is changed. The return losses at the feeding end 5*a* correspond to input impedances.

As seen from FIG. 3, when the capacitance of the variable capacitance diode D1 to D3 is changed by several pF while the frequency of the input signal is being fixed, the return loss can be changed between −2 dB and −18 dB around an input signal frequency of 2.57 GHz, and the non-feeding end 5*b* of the line antenna 5 is changed between an open-circuited state and another state where the non-feeding end (5*b*) is terminated via the stub 45. When the capacitance of the variable capacitance diode D4 is changed, a resonant frequency of the line antenna 5 can be changed.

The capacitor Cj (j=1 to 4) has a large capacitance so that the capacitor Cj has an impedance small enough to be in the short-circuited state at an operating frequency. The variable capacitance diode Dj is set so that: when the control voltage Vj is zero, the variable capacitance diode Dj has an impedance small enough to be in the short-circuit state at the operating frequency; when the control voltage Vj is a maximum value Vmax, the variable capacitance diode Dj has an impedance large enough to be in the open-circuit state at the operating frequency. Accordingly, at the operating frequency, a path length between the metal plate 35 and the conductive layer 31 or a path length between the stub 45 and the conductive layer 31 is changed with changing voltage Vj between 0 and Vmax. In such a case, a path length between the non-feeding end 5*b* of the line antenna 5 and the conductive layer 31 is changed with changing voltage Vj between 0 and Vmax. Note that the path length corresponds to a phase of a signal traveling through the via hole.

(Antenna Operation Mode)

The above antenna apparatus 1 can operate in three operation modes by properly changing the control voltages V1 to V4. The three operation modes are a monopole antenna mode, a 3-elements array antenna mode, and a microstrip antenna mode.

In the monopole antenna mode, the control voltage V4 is set so that the non-feeding end 5*b* of the line antenna 5 is almost in the open-circuit state, and the line antenna operates as a resonant antenna. Further, the control voltages V1 to V3 are set so that the board 3 acts as an Electromagnetic Band-Gap (EBG) board.

Figure 4A:
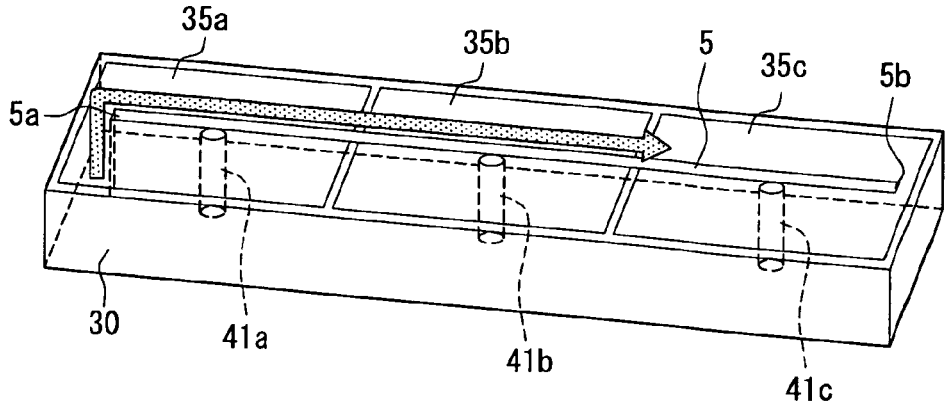
FIG. 4A is diagram illustrating current distributions in a monopole antenna mode.

In the above setting, a reverse current does not flow in the board 3, which is located directly underneath the line antenna 5. Thus, the line antenna 5 acts as a monopole antenna or an inverted-L antenna. FIG. 4A is a diagram illustrating a current distribution when the antenna apparatus 1 operates in the monopole antenna mode. In FIG. 4A, the arrow represents the current distribution.

In the 3-elements array antenna mode, the control voltage V4 is set so that the non-feeding end 5*b* of the line antenna 5 is almost in the open-circuit state and the line antenna 5 acts a resonant antenna. Further, the control voltages V1 to V3 are properly set so that in-phase large currents flow in the group of first via holes.

Figure 4B:
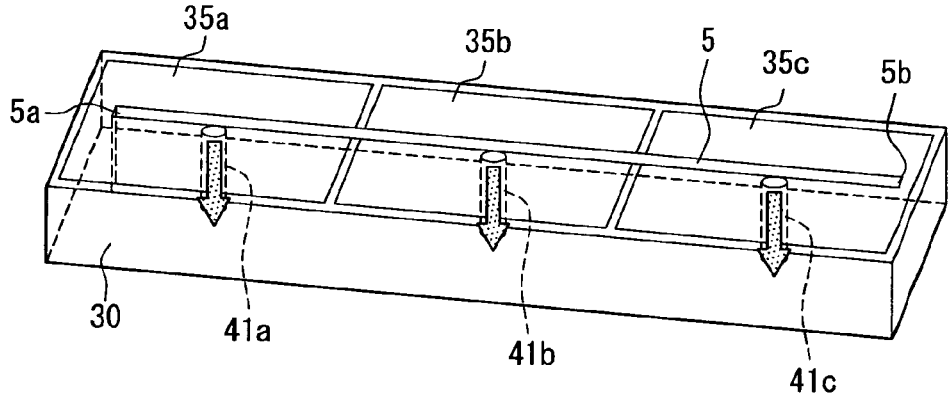
FIG. 4B is diagram illustrating current distributions in a 3-elements array antenna mode.

In the above setting, the first via holes 41 individually operate as antenna elements, and the first via holes 41 operate as a 3-elements array antenna as a whole. FIG. 4B is a diagram illustrating a current distribution when the antenna apparatus 1 operates in the 3-elements array mode. In FIG. 4B, the current distribution is represented by the arrows.

In the microstrip antenna mode, the control voltage is set so that the non-feeding end 5*b* of the line antenna 5 is almost in the open-circuit state. Further, the control voltages V1 to V3 are properly set so that the metal plates 35 and the conductive layer 31 are insulated from each other.

Figure 4C:
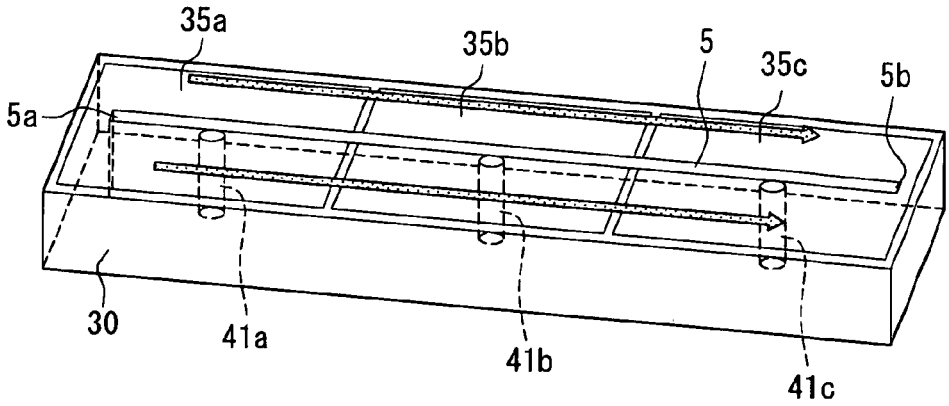
FIG. 4C is diagram illustrating current distributions in a microstrip antenna mode.

In the above setting, the metal plates 35 operate as a patch antenna that operates by power feeding from the line antenna 5. FIG. 4C is a diagram illustrating a current distribution when the antenna apparatus 1 operates in the microstrip antenna mode. In FIG. 4B, the current distribution is represented by the arrows.

In the above-described operation modes, the line antenna 5 operates as a resonant antenna. Alternatively, the line antenna 5 can operate as a traveling wave antenna when the control voltage V4 is set so that the non-feeding end 5*b* of the line antenna 5 is substantially terminated.

(Measurement)

Figure 5A:
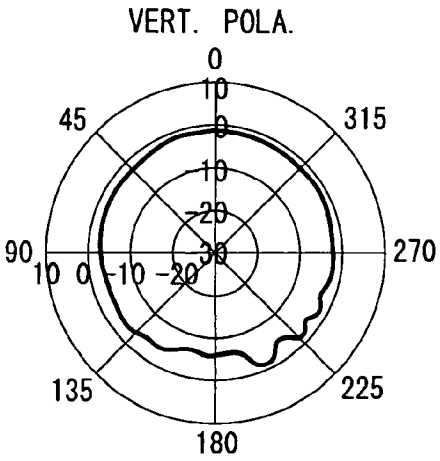
FIG. 5A is diagram illustrating a radiation pattern in a monopole antenna mode.
Figure 5A:
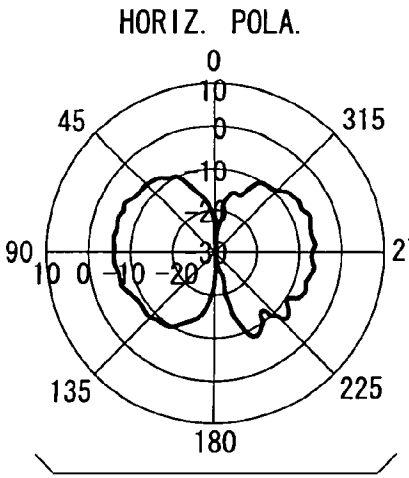
Figure 5B:
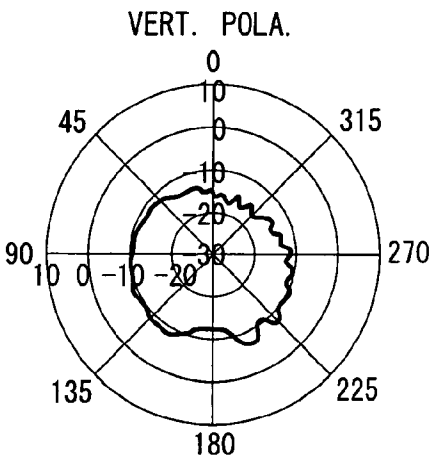
FIG. 5B is diagram illustrating a radiation pattern in a 3-elements array antenna mode.
Figure 5B:
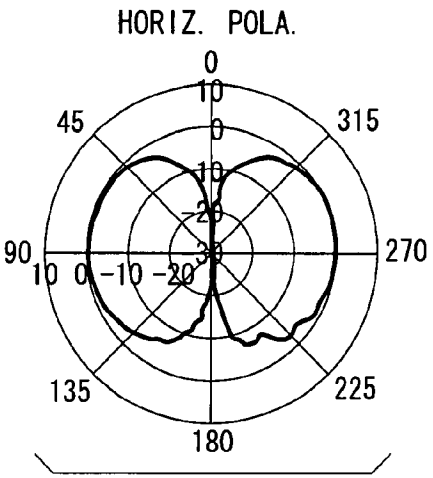
Figure 5C:
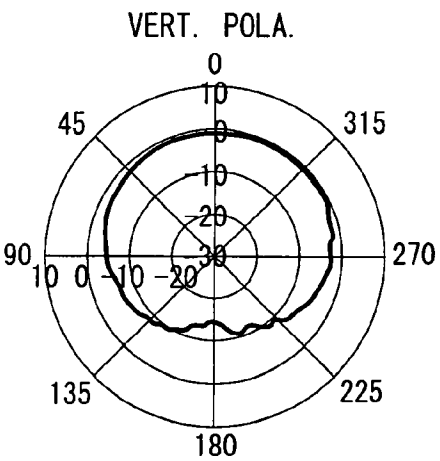
FIG. 5C is a diagram illustrating a radiation pattern in a microstrip antenna mode.
Figure 5C:
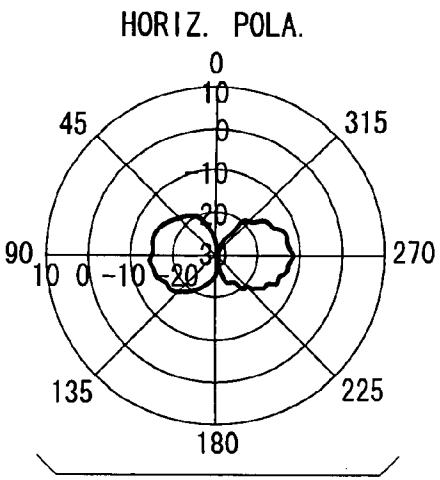

FIGS. 5A to 5C are graphs illustrating measurement results of radiation pattern. FIG. 5A illustrates a case where the antenna apparatus 1 operates in the monopole antenna mode. FIG. 5B illustrates a case where the antenna apparatus 1 operates in the 3-elements array mode. FIG. 5C illustrates a case where the antenna apparatus 1 operates in the microstrip mode.

Figure 6:
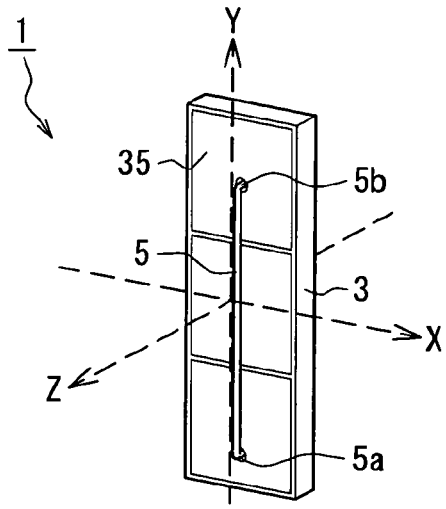
FIG. 6 is a diagram illustrating a coordinate system with X, Y and Z axes for an antenna apparatus.

FIGS. 5A to 5C illustrate vertical and horizontal polarization characteristics on X-Z plane where a coordinate system is defined as that seen in FIG. 6. A Y axis is defined as an axis along which the line antenna 5 extends, a Z axis is a thickness direction of the board 3, and an X axis is perpendicular to the Y axis and the Z axis. In FIGS. 5A to 5C, the 0 degree is a direction of the Z axis, which is normal to the band gap surface of the board 3.

The antenna device having the following dimensions was used to obtain the measurement results shown in FIGS. 5A to 5C. The board base part 30 was a glass epoxy board with 42.5 mm long in a longitudinal direction (Y axis) thereof, 14.5 mm long in a lateral direction (X axis) thereof, and 3.2 mm long in a thickness direction (Z axis) thereof. The line antenna 5 was 33 mm long, and is spaced 0.5 mm from the band gap surface of the board 3. Each metal plate 35 was 13.5 mm by 13.5 mm in size. The interval between the metal plates 35 was 0.5 mm.

For example, when the antenna apparatus 1 is used for inter-vehicle communication, the following switching control is possible based on the characteristics illustrated in FIG. 5. If few vehicles exist around the subject vehicle equipped with the antenna apparatus 1, the antenna apparatus 1 may operate in the monopole antenna mode for vertical polarized waves so as to perform omni-directional communication in a vehicle periphery. If many vehicles exist around the subject vehicle, the antenna apparatus 1 operates in the microstrip mode for vertical polarized waves so that emphasis is placed on communication in the forward direction of the subject vehicle. In an intersection, the antenna apparatus 1 operates in the 3-elements array antenna mode for horizontal polarization waves so that emphasis is placed on communication in the lateral direction of the subject vehicle.

As described above, the antenna apparatus 1 is configured such that the metal plates 35, which are located on the band gap surface of the board 3 having the EBG structure, are not simply connected with the conductive layer 31 acting as ground but are connected with the conductive layer 31 via the variable capacitance diodes D. By adjusting the capacitances of the variable capacitance diodes D, the antenna apparatus 1 can operate in three operation modes whose characteristics are different from each other.

According to the antenna apparatus 1, it is possible to largely change antenna directivity by switching the operation mode, and further, it is possible to switch the operation mode by electrical control that includes changing the control voltages.

According to the antenna apparatus 1, since the capacitors C are provided between the control terminals TC (to which the control voltages are applied) and the metals plate 35, and provided between the control terminal TC and the stub 45, it is possible to prevent a source of the control voltage V and a power feeding source of the line antenna 5 from short-circuiting therebetween if the line antenna 5 and the metal plate 35 become conductive therebetween for any reason.

(Modifications)

The above described embodiments can be modified in various ways, examples of which will be described below.

Figure 7A:
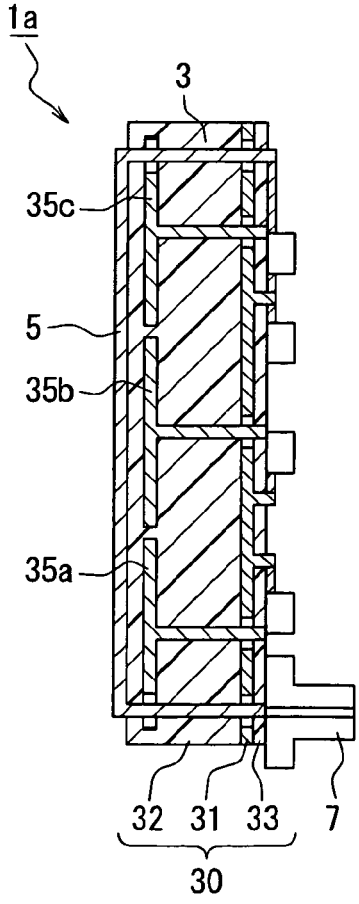
FIG. 7A is a diagram illustrating a sectional view of an antenna apparatus according a first exemplary modification.

In the above embodiments, the line antenna 5 is spaced apart from the band gap surface of the board 3 so as not to contact with the band gap surface. Alternatively, as illustrated in FIG. 7A, an antenna apparatus 1*a* may be configured such that the metal plates providing the band gap surface are buried in the first dielectric layer 32. The line antenna 5 may be placed so as to contact with the first dielectric layer 32, or, the line antenna 5 may be a pattern arranged on the first conductive layer 32.

According to the above described alternative configuration illustrated in FIG. 7A, it is possible to ensure insulation between the line antenna 5 and the board 3, and it is possible to minimize an amount of projection of the line antenna 5 from the band gap surface. It is therefore possible to reduce the thickness of the antenna apparatus 1. Further, since the line antenna 5 and the board 3 are reliably insulated from each other by the first dielectric layer 32, the antenna apparatus 1 may not necessarily have the capacitors C1 to C4 for preventing short circuit.

Alternatively, the band gap surface of the board 3 and the line antenna 5 may be covered as a whole by a high-dielectric layer. In this configuration, it is possible to reduce the size of the line antenna 5 by utilizing a wavelength shortening effect caused by the presence of the high-dielectric layer, and it is possible to reduce the size of the antenna apparatus 1.

In the above described antenna apparatus 1, a part of the board base part 30 between the conductive layer 31 and the metal plates 35 is filled with the first dielectric layer 32. Alternatively, as illustrated in FIG. 7B, an antenna apparatus 1*b* may be configured such that the first dielectric layer 32 is so thin that the first dielectric layer 32 and the metal plates 35 form therebetween a space and face each other through the space.

Figure 7B:
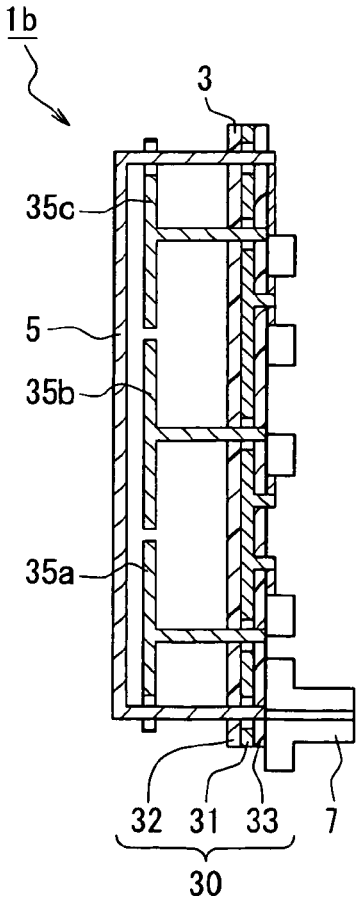
FIG. 7B is a diagram illustrating a sectional view of an antenna apparatus according a second exemplary modification.

According to the above described alternative configuration illustrated in FIG. 7B, it is possible to maximally minimize an influence of stray capacitance formed between the conductive layer 31 and the metal plates 35. If an acceptable value of the stray capacitance is constant, it is possible to reduce an interval between the conductive layer 31 and the metal plates 35 as small as the acceptable stray capacitance reaches the acceptable value, and therefore, it is possible to further reduce the thickness of the antenna apparatus 1.

(Aspects)

The above described embodiments and modifications have the following aspects.

According to an aspect, an antenna apparatus is provided. The antenna apparatus includes a board and a line antenna. The board includes a base part, multiple metal plates and a connection part. The base part has a pair of dielectric layers and a conductive layer disposed between the pair of dielectric layers. The multiple metal plates are the same in shape, and are two dimensionally arranged on one surface of the base part while being spaced apart at even intervals so that the one surface of the base part is configured to be a band-gap surface that blocks propagation of electromagnetic wave within a predetermined frequency band. The conductive layer is electrically connectable with the multiple metal plates via the connection part. The line antenna is located on a band-gap surface side of the board, is arranged along the band gap surface, and is configured to receive and transmit the electromagnetic wave within an operating frequency band. The operating frequency band is within the predetermined frequency band. The connection part includes a first adjustment circuit that is configured to individually adjust an impedance between the conductive layer and each of the multiple metal plates.

The above antenna apparatus can operate as a monopole antenna, an array antenna, or a patch antenna depending on the impedance between the conductive layer and each of the multiple metal plates the first adjustment circuit, the impedance being adjusted by the first adjustment circuit.

For example, when the impedance between the conductive layer and each of the multiple metal plates is adjusted so that the conductive layer and each of the multiple metal plates are short-circuited therebetween at the operating frequency band, the one surface on which the multiple metal plates are arranged becomes a high impedance plane (HIP). As a result, the antenna apparatus operates as the monopole antenna.

When the impedance between the conductive layer and each of the multiple metal plates is adjusted so that large in-phase currents flow through link parts respectively interconnecting between the conductive layer and the multiple metal plates, the antenna apparatus operates as an array antenna where antenna elements are the link parts.

When the impedance between the conductive layer and each of the multiple metal plates is adjusted so that the conductive layer and each of the multiple metal plates are insulated from each other at the operating frequency band, each metal plate operates as a patch antenna.

When the antenna apparatus operates as the array antenna or the patch antenna, the impedance between the conductive layer and the metal plate is adjusted so that power is supplied to the metal plate or the connection part via the line antenna.

According to the above antenna apparatus, the electrically controlling of the first adjustment circuit enables the single antenna apparatus to operate as three antennas whose characteristics are different from each other. A directivity of the antenna apparatus can be largely changed without the use of mechanical control.

The above antenna apparatus may be configured such that the multiple metal plates are arranged in a single line so as to be located just beneath the line antenna. Further, the above antenna apparatus may be configured such that the connection part further includes a second adjustment circuit that is configured to adjust an impedance between the conductive layer and a non-power feeding end of the line antenna.

According to the above antenna apparatus, the line antenna can act as a resonant antenna when the second adjustment circuit adjusts the impedance between the conductive layer and the non-power feeding end of the line antenna so that the non-power feeding end is in an open-circuited state at the operating frequency band. Further, the line antenna can act as a traveling wave antenna when the second adjustment circuit adjusts the impedance between the conductive layer and the non-power feeding end of the line antenna so that, at the operating frequency band, the non-power feeding end is terminated so as to prevent reflection from taking place at the non-power feeding.

The above antenna apparatus may be configured such that the first adjustment circuit includes multiple variable capacitance diodes. According to this configuration, a scale of the first adjustment circuit can be reduced. In addition, impedances of the first adjustment circuit can be controlled with ease by controlling voltages applied to the multiple variable capacitance diodes.

The above antenna apparatus may be configured such that: the first adjustment circuit further includes multiple capacitors for preventing short circuit; and the multiple capacitors are respectively connected between the multiple variable capacitance diodes and the multiple metal plates. According to this configuration, even if the line antenna contacts with the metal plate, short-circuiting between the line antenna and the conductive layer functioning as ground can be prevented.

The above antenna apparatus may be configured such that the first adjustment circuit is located on an opposite side of the board from the band-gap surface. According to this configuration, the first adjustment circuit can be easily mounted compared to a configuration where the first adjustment circuit is located inside the board.

The above antenna apparatus may be configured such that: the board further includes a cover layer; the cover layer covers the band-gap surface and is made of a dielectric material; and the line antenna is a pattern arranged on the cover layer. According to this configuration, since a process of attaching the line antenna to the board is not necessary, it is possible to simplify a manufacturing process of the antenna apparatus.

The above antenna apparatus may be configured such that: the pair of dielectric layers are a first dielectric layer and a second dielectric layer, between which the conductive layer is disposed; the first dielectric layer is disposed between the multiple metal plates and the conductive layer; the second dielectric layer is disposed on an opposite side of the conductive layer from the first dielectric layer; the first dielectric layer is air; and the multiple metal plates is in non-contact with the conductive layer.

According to the above antenna apparatus, a dielectric constant between the multiple metal plates and the conductive layer can be minimized. As a result, it is possible to maximally minimize an influence of stray capacitance formed between the conductive layer 31 and the metal plates 35. It is possible to maximally reduce the thickness of the board to the extent that the stray capacitance reaches an acceptable value.

While the invention has been described above with reference to various embodiments thereof, it is to be understood that the invention is not limited to the above described embodiments and constructions. The invention is intended to cover various modifications and equivalent arrangements. In addition, while the various combinations and configurations described above are contemplated as embodying the invention, other combinations and configurations, including more, less or only a single element, are also contemplated as being within the scope of embodiments.

What is claimed is:

1. An antenna apparatus comprising:

a board that includes:

a base part that has a pair of dielectric layers and a conductive layer disposed between the pair of dielectric layers;

a plurality of metal plates having the same shape, and that are two dimensionally arranged on one surface of the base part while being spaced apart at even intervals so that the one surface of the base part is configured to be a band-gap surface that blocks propagation of electromagnetic wave within a predetermined frequency band; and a plurality of first connection parts electrically connecting the conductive layer with the plurality of metal plates, respectively; and a line antenna that is located on a band-gap surface side of the board, is arranged along the band gap surface, and is configured to receive and transmit the electromagnetic wave within an operating frequency band, wherein the operating frequency band is within the predetermined frequency band, wherein the plurality of first connection parts include a plurality of first adjustment circuits, respectively;

the plurality of first adjustment circuits include a plurality of variable capacitance diodes, respectively, and are configured to individually adjust respective impedances between the conductive layer and the plurality of the metal plates;

the plurality of first adjustment circuits further include a plurality of capacitors for preventing short-circuit between the plurality of metal plates and the conductive layer under a predetermined condition, respectively; and the plurality of capacitors are connected between the plurality of variable capacitance diodes and the plurality metal plates, respectively.

2. The antenna apparatus according to claim 1, wherein:

the plurality of metal plates are arranged in a single line that is parallel to the line antenna.

3. The antenna apparatus according to claim 1, wherein:

the board further includes a second connection part which includes a second adjustment circuit that is configured to adjust an impedance between the conductive layer and a non-power feeding end of the line antenna.

4. The antenna apparatus according to claim 1, wherein:

the plurality of first adjustment circuits are located on an opposite side of the board from the band-gap surface.

5. The antenna apparatus according to claim 1, wherein:

the board further includes a cover layer;

the cover layer covers the band-gap surface and is made of a dielectric material; and the line antenna is a pattern arranged on the cover layer.

6. The antenna apparatus according to claim 1, wherein:

the pair of dielectric layers are a first dielectric layer and a second dielectric layer, between which the conductive layer is disposed;

the first dielectric layer is disposed between the plurality of metal plates and the conductive layer;

the second dielectric layer is disposed on an opposite side of the conductive layer from the first dielectric layer;

the first dielectric layer is air; and the plurality of metal plates are not in direct contact with the conductive layer.

7. The antenna apparatus according to claim 1, wherein:

the plurality of first adjustment circuits further include a plurality of control terminals which are connected between the plurality of capacitors and the plurality of variable capacitance diodes, respectively; and a plurality of voltages are inputted to the plurality of respective control terminals to change respective capacitances of the plurality of variable capacitance diodes and adjust the respective impedances between the conductive layer and the plurality of the metal plates.

8. The antenna apparatus according to claim 7, wherein:

the antenna apparatus selectively operates in a monopole antenna mode, an array antenna mode and a patch antenna mode according to the control voltages applied to the respective control terminals;

the antenna apparatus operates in the monopole antenna mode when the impedances between the conductive layer and the respective metal plates are adjusted so that the conductive layer and each of the plurality of metal plates is short-circuited therebetween at the operating frequency band;

the antenna apparatus operates in the array antenna mode when the impedances are adjusted so that the in-phase currents flow through the respective connection parts; and the antenna apparatus operates in the microstrip antenna mode when the impedances are adjusted so that the conductive layer and each of the metal plates are insulated from each other.

* * * * *